United States Patent [19]

Ridenour

[11] Patent Number: 5,025,990

[45] Date of Patent: Jun. 25, 1991

[54] ADJUSTABLE GAS NOZZLE

[75] Inventor: Ralph G. Ridenour, Mansfield, Ohio

[73] Assignee: Universal Enterprises, Inc., Mansfield, Ohio

[21] Appl. No.: 420,330

[22] Filed: Oct. 12, 1989

[51] Int. Cl.[5] ..... B05B 1/16

[52] U.S. Cl. ..... 239/438; 239/443

[58] Field of Search ..... 239/438, 443, 440, 441, 239/390, 396, 581.2

[56] References Cited

U.S. PATENT DOCUMENTS

| | | | |
|---|---|---|---|
| 576,259 | 2/1897 | Diamond | 239/438 |
| 2,785,926 | 3/1957 | Lataste | 239/438 |
| 2,944,743 | 7/1960 | Kachergis | 239/438 |
| 4,095,747 | 6/1978 | Anderson | 239/443 |

FOREIGN PATENT DOCUMENTS

| | | | |
|---|---|---|---|
| 534538 | 1/1955 | Belgium | 239/396 |
| 535521 | 2/1955 | Belgium | 239/396 |
| 3007290 | 9/1981 | Fed. Rep. of Germany | 239/441 |
| 3488 | of 1902 | United Kingdom | 239/581.2 |

*Primary Examiner*—Andres Kashinikow
*Assistant Examiner*—Christopher G. Trainor
*Attorney, Agent, or Firm*—Pearne, Gordon, McCoy & Granger

[57] ABSTRACT

A gas nozzle has a body threaded on a threaded conduit with an insert therebetween. This insert is not changed for another insert in order to adapt the nozzle to either natural gas or LP gas; instead, the body is tightened onto the insert and threaded conduit for LP gas and is loosened about one thread for natural gas. The insert has a first restricted orifice and a bypass passageway around this restricted orifice. The body has a second restricted orifice which is larger than that of the first restricted orifice. Thus, when the body is tightened on the conduit, a seal is made to close off the bypass passageway and the gas flow is through the first and second restricted orifices in series. When the body is loosened, the bypass passageway comes into effect and the gas flow is also through the bypass passageway to be restricted only by the second restricted orifice. The foregoing abstract is merely a resume of one general application, is not a complete discussion of all principles of operation or applications, and is not to be construed as a limitation on the scope of the claimed subject matter.

23 Claims, 2 Drawing Sheets

ADJUSTABLE GAS NOZZLE

BACKGROUND OF THE INVENTION

In a number of gas-heated appliances, usually for households, it is common for a manufacturer to provide two different nozzle assemblies so that a nozzle with a first restriction may be used if the household is equipped to burn liquefied petroleum gas, or LPG, and a second nozzle assembly with a less restricted outlet if the household is equipped to use natural gas in the gas appliance. This is due to the lower BTU content of natural gas compared with LPG to achieve the same rate of BTU output of the gas appliance.

In many cases, the two alternative gas nozzle assemblies are ones wherein the gas to the nozzle comes through a conduit, a cap is fitted onto the end of the conduit, and the cap holds in place either one of two different inserts which have different size openings for the two types of gas. Once installed, the other insert often gets lost so that it becomes difficult to convert the appliance to the other type of gas. Also, merely assembling the proper insert in the nozzle assembly by a householder may be most difficult for one with arthritic fingers, for example, and often the gas nozzle assembly is in a relatively inaccessible space within the gas appliance.

SUMMARY OF THE INVENTION

The problem to be solved, therefore, is how to construct a gas nozzle which eliminates the two separate inserts and yet is adjustable to two different gas flow rates, one for natural gas and one for LPG.

This problem is solved by an adjustable gas nozzle comprising, in combination, a body having an axis and a longitudinal conduit therethrough with an inlet opening at a first end, a second end of said body having an outlet, conduit means having an outlet, coupling means between said conduit means and said body to permit first and second alternative relative positions therebetween, one of said outlets being a first restricted orifice, a bypass passageway around said first restricted orifice, means in said first position to seal between said body and said conduit means to close off flow through said bypass passageway to permit a first gas flow through the two outlets in series so that gas flow rate is regulated by said first restricted orifice, and said body being movable into said second position relative to said conduit means to relieve said seal means and to permit a second gas flow of an amount greater than said first gas flow through the combination of said first restricted orifice and said bypass passageway.

The problem is further solved by a coaxial adjustable gas nozzle comprising, in combination, a body having an axis and a coaxial conduit therethrough with a threaded inlet opening at a first end, a second end of said body having a coaxial outlet and an internal circular surface, threaded conduit means to receive said body, a first restricted orifice as an outlet from said threaded conduit means, said coaxial outlet of said body being a second restricted orifice, one of said first and second restricted orifices being smaller in diameter than the other, an external circular surface on said conduit means to seal with said internal circular surface of said body and reacting axially on said threaded conduit means upon threadably tightening said body and said threaded conduit means, means upstream of said seal for additional gas flow to permit a first gas flow when said body is only loosely threaded with said threaded conduit means, and said body being tightenable relative to said threaded conduit means to make a seal between said internal and external circular surfaces to permit a second gas flow of an amount less than said first gas flow through only said first and second restricted orifices in series.

Accordingly, an object of the invention is to provide an adjustable gas nozzle adjustable to different gas flow rates.

Another object of the invention is to provide an adjustable gas nozzle wherein it is not required to substitute one insert for another in order to change gas rates.

Other objects and a fuller understanding of the invention may be had by referring to the following description and claims, taken in conjunction with the accompanying drawing.

DESCRIPTION OF THE PREFERRED EMBODIMENT

Figure 1:
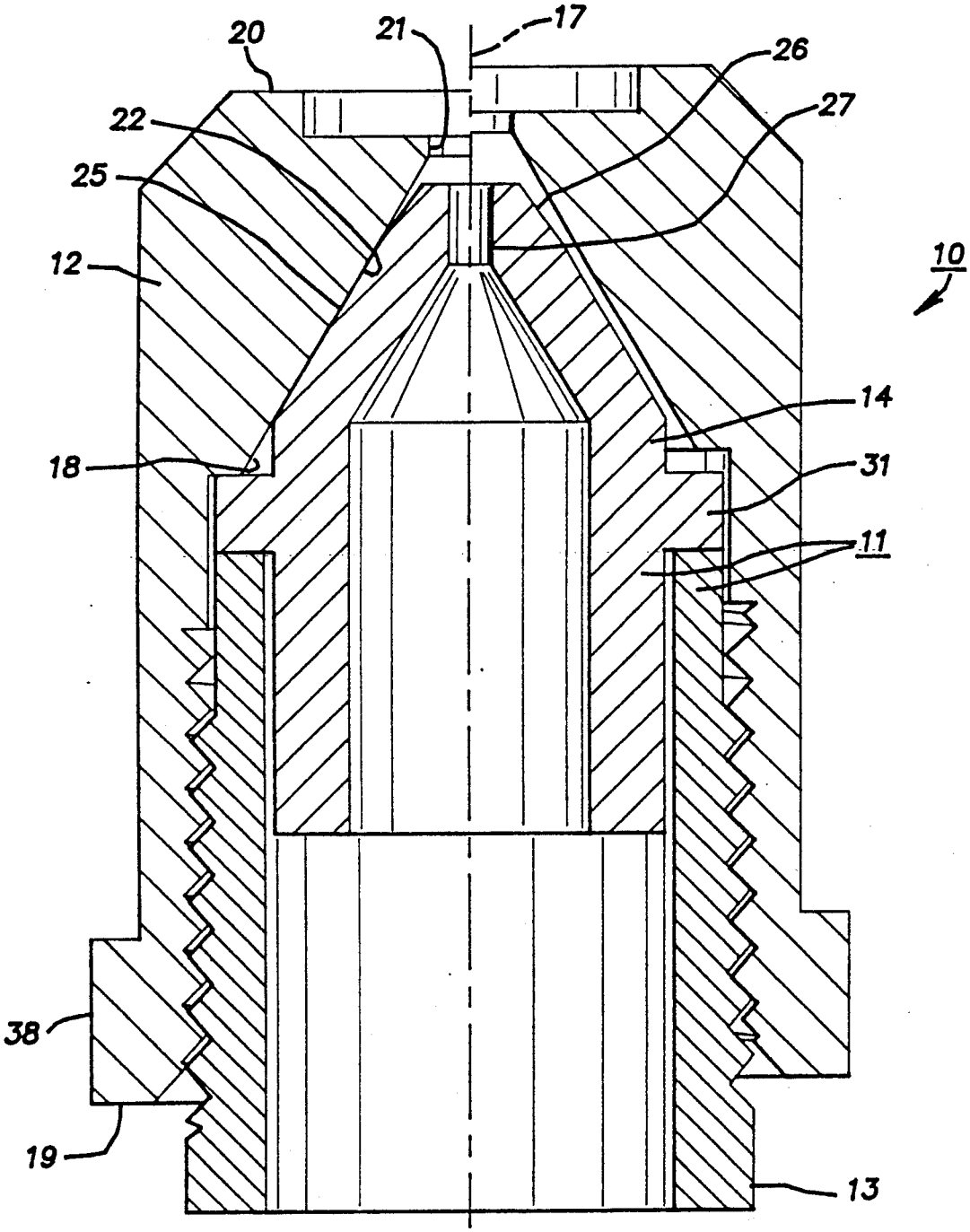
FIG. 1 is a longitudinal, sectional view of a gas nozzle constructed in accordance with the invention.
Figure 2:
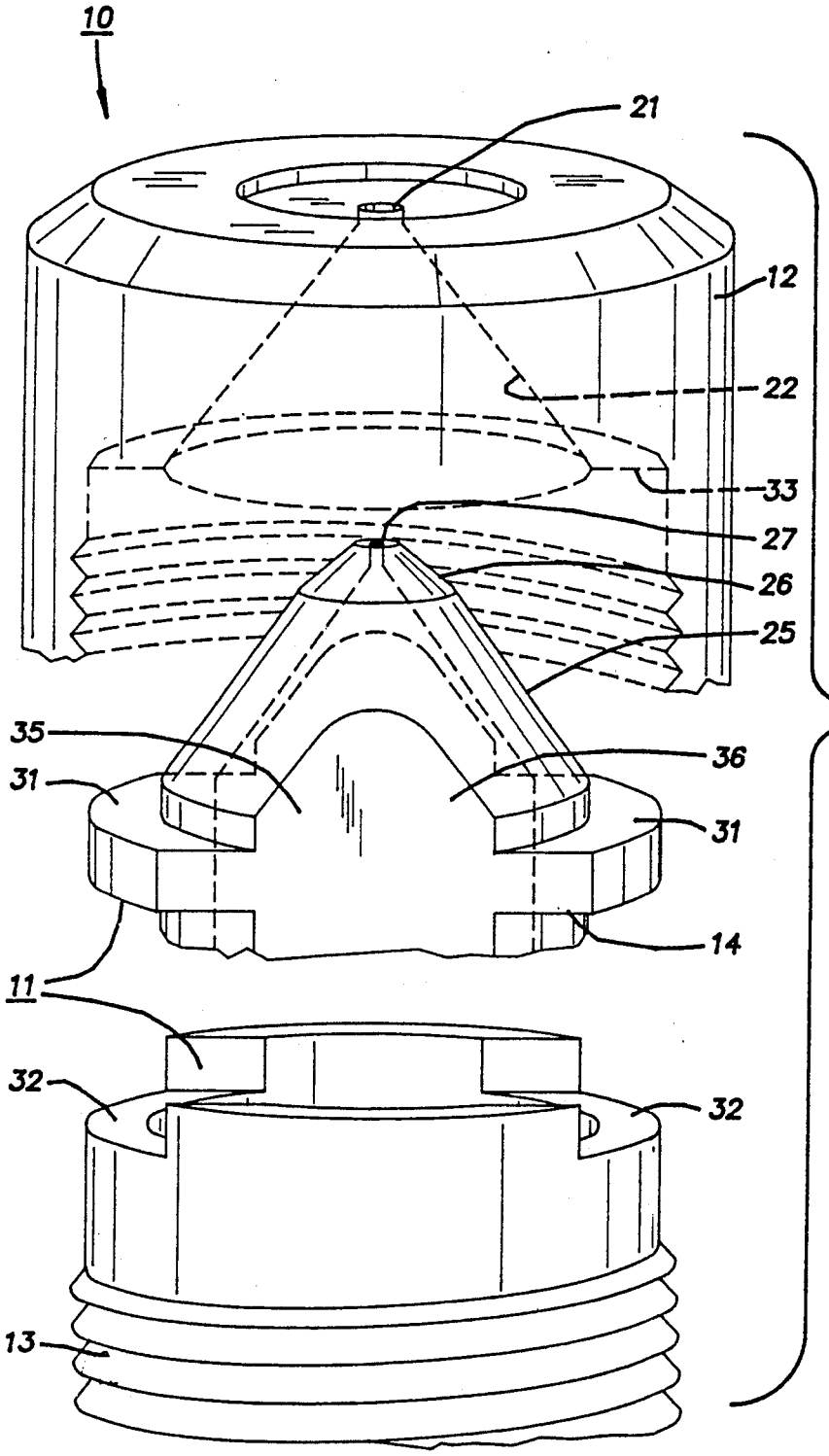
FIG. 2 is an exploded, perspective view thereof.

The gas nozzle 10 shown in FIGS. 1 and 2 includes two main parts: conduit means 11 for the gas and a body 12. In this preferred embodiment, the conduit means 11 includes generally a threaded conduit 13 and a separate insert 14.

The body 12 has a longitudinal axis 17. The body also has a coaxial conduit 18 therethrough with a threaded inlet opening at a first end 19. The threads on the body 12 coact with the threads on the threaded conduit 13, and in this embodiment, the threaded conduit 13 has male threads. A second end 20 has a coaxial outlet 21. The body 12 also has an internal circular surface 22 which is a conical surface defining part of the passageway through this body 12.

The separate insert 14 has a longitudinal passageway therethrough coaxial with the axis 17. The insert has an external circular surface 25 which is also conical at the same angle as the conical surface 22. The very tip 26 of the insert 14 has a conical surface of a slightly larger included angle. The internal conical surface 22 is adapted to seal with the external conical surface 25 when the body 12 is threaded onto the threaded conduit 13, except the tip end 26 does not make contact, and hence will not crush inwardly to make the outlet 27 more restricted. This outlet 27 is a first restricted orifice and the outlet 21 is a second restricted orifice. One of these restricted orifices is smaller in diameter than the other, and in this preferred embodiment the first restricted orifice 27 is smaller in diameter than the second restricted orifice 21.

A shoulder on the threaded conduit 13 is cooperable with a shoulder on the insert 14. In this preferred embodiment, the shoulder on the insert is formed by two opposed wings 31. The shoulder on the threaded conduit 13 is formed by two opposed recesses 32. The thickness of the wings 31 in an axial direction is slightly greater than the depth of the recesses 32. This means that when the body 12 is threadably tightened onto the threaded conduit 13, an annular shoulder 33 on the body 12 forces the material of the wings slightly into the material of the threaded conduit 13. For example, the body 12 and insert 14 may be made of brass and the threaded conduit may be made of aluminum, which is softer to be slightly compressed by the wings 31.

A bypass passageway 35 is provided around the first restricted orifice 27. In this preferred embodiment, it is provided in the conduit means 11, and more specifically in the insert 14. The bypass passageway is provided by two flattened sides 36 on the insert 14 which are parallel to the axis 17.

In the preferred embodiment, the external circular surface 25 is a cone of 60 degrees and the larger cone 26 is one of 75 degrees included angle. The conical surface 25 is 60 degrees with a tolerance of +0 and −1 degree. The internal circular surface 22 is also a cone of approximately 60 degrees, with a tolerance of −0 degrees and +1 degree. This assures that the seal between the body 12 and the insert 14 is just at and just below the intersection of the cones 25 and 26 on the insert 14. As an example, suppose the cone 25 has an angle of 59 degrees, 40 minutes, and the cone 22 has an angle of 60 degrees, 10 minutes: it will be observed that the two cones 25 and 22 diverge slightly as they approach the opposed wings 31. Hence, the seal will be just at and just below the intersections of the cones 25 and 26, e.g., for a distance of 0.040". At this place, the wall thickness of the insert 14 is quite substantial so that, even though a considerable torque is applied to the body 12 to tighten it on the threaded conduit 13, there will be no inward crushing or distortion of the first restricted outlet 27. This assures that the amount of gas flow through this first restricted outlet will not be affected by too much tightening torque.

OPERATION

FIG. 2 shows the parts ready to be assembled and the left half of FIG. 1 shows the three parts tightened by means, for example, of a wrench or wrench pads 38 of the body 12. This tightening makes a seal between the said internal conical surface 22 of the body 12 and the external conical surface 25 of the conduit means 11. This is shown in the left half of FIG. 1. When so tightened, the annular shoulder 33 slightly crushes the wings 31 into the recesses 32. This assures that the insert 14 is held tightly in the end of the threaded conduit 13 so that there is assurance that the seal is made between the conical surfaces 22 and 25. When the body 12 is loosened about two threads, as shown in the right half of FIG. 1, the seal is eliminated and the bypass passageway 35 comes into use. This is a means upstream of the seal at 22–25 for additional gas flow, to permit a first gas flow when the body 12 is only loosely threaded on the threaded conduit 13. In this case, the gas flow is regulated by the area of the second restricted orifice 21, which is larger than that of the first restricted orifice 27. This, then, might be the condition for use of the nozzle with natural gas.

When the body 12 is tightened on the threaded conduit 13 to make the seal at 22–25, then the bypass passageway around the first restricted outlet 27 is eliminated. This permits a second gas flow of an amount less than the first gas flow through only the first and second restricted orifices in series. This, then, might be in the condition for use with LPG gas, which has a higher BTU content.

The interthreading between the body 12 and threaded conduit 13 is a coupling means to permit first and second alternative relative positions therebetween. In the first position, there is a seal between the body and the conduit means to close off flow through the bypass passageway 35. In the second position, with the body 12 loosened, there is a second gas flow of an amount greater than the first gas flow through the combination of said first restricted orifice and said bypass passageway. When the internal conical surface 22 of the body 12 seals against the external conical surface 25 of the insert 14, there is an axial reaction of the body relative to the threaded conduit 13 which is resisted by the interthreading of the two. The two flattened sides 36 on the inset 14 is a means to establish a noncircular cross section on this insert, thus forming the bypass passageway 35.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. An adjustable gas nozzle comprising, in combination:

a body having an axis and a longitudinal conduit therethrough with an inlet opening at a first end;

a second end of said body having an outlet;

conduit means having an outlet;

coupling means between said conduit means and said body to permit first and second alternative relative positions therebetween;

one of said outlets being a first restricted orifice;

a bypass passageway around said first restricted orifice;

means in said first position to seal between said body and said conduit means to close off flow through said bypass passageway to permit a first gas flow through the two outlets in series so that gas flow rate is regulated by said first restricted orifice;

means upstream of said sealing means for restricting further upstream axial displacement of said body relative to said conduit means in said first position; and said body being movable into said second position relative to said conduit means to relieve said seal means and to permit a second gas flow of an amount greater than said first gas flow through the combination of said first restricted orifice and said bypass passageway.

2. An adjustable gas nozzle as set forth in claim 1, wherein said coupling means includes threads on each of said body and said conduit means.

3. An adjustable gas nozzle as set forth in claim 1, wherein said longitudinal conduit through said body is coaxial.

4. An adjustable gas nozzle as set forth in claim 1, wherein the other of said outlets is a second restricted orifice.

5. An adjustable gas nozzle as set forth in claim 4, wherein each of said restricted orifices is coaxial.

6. An adjustable gas nozzle as set forth in claim 4, wherein one of said restricted orifices is smaller than the other.

7. An adjustable gas nozzle as set forth in claim 1, wherein said conduit means includes a hollow conduit and a separate insert.

8. An adjustable gas nozzle as set forth in claim 7, wherein said separate insert contains said first restricted orifice.

9. An adjustable gas nozzle as set forth in claim 7, wherein said separate insert contains said bypass passageway which includes at least one longitudinal groove on a side thereof.

10. An adjustable gas nozzle as set forth in claim 1, wherein said means for restricting further axial displacement of said body relative to said conduit means includes:

a first shoulder on said body between said first end and said second end of said body;

a second shoulder on said conduit means facing said body and positioned so that it will engage said first shoulder on said body when said body and said conduit means are in said first position.

11. An adjustable gas nozzle as set forth in claim 10, wherein said conduit means includes a hollow conduit and a separate insert, and wherein said insert includes radially extending wings which include said second shoulder.

12. A coaxial adjustable gas nozzle comprising, in combination:

a body having an axis and a coaxial conduit therethrough with a threaded inlet opening at a first end; a second end of said body having a coaxial outlet and an internal circular surface;

threaded conduit means to receive said body;

a first restricted orifice as an outlet from said threaded conduit means;

said coaxial outlet of said body being a second restricted orifice, one of said first and second restricted orifices being smaller in diameter than the other;

an external circular surface on said conduit means including a first cone of a first included angle which forms a seal with said internal circular surface of said body and including a second cone of a larger included angle than said first cone, said external circular surface reacting axially on said threaded conduit means upon threadably tightening said body and said threaded conduit means;

means upstream of said seal for additional gas flow to permit a first gas flow when said body and said threaded conduit means do not form said seal; and said body being tightenable relative to said threaded conduit means to make said seal between said internal and external circular surfaces near a junction of said first and second cones to permit a second gas flow of an amount less than said first gas flow through only said first and second restricted orifices in series.

13. A gas nozzle as set forth in claim 12, wherein said threaded inlet opening in said body is an internal thread.

14. A gas nozzle as set forth in claim 10, wherein said second cone is closer to said first restricted orifice than said first cone.

15. A gas nozzle as set forth in claim 12, wherein the body has a first shoulder between the first and second ends and the conduit means includes a second shoulder so positioned that it engages the first shoulder when the body and the conduit means form said seal.

16. A gas nozzle as set forth in claim 12, wherein said additional gas flow means is a bypass passageway around said first restricted outlet.

17. A gas nozzle as set forth in claim 12, wherein said conduit means includes a threaded conduit and a separate insert.

18. A gas nozzle as set forth in claim 17, wherein said additional gas flow means is a non-circular cross section on said separate insert.

19. A gas nozzle as set forth in claim 17, wherein said separate insert has said external circular surface.

20. A gas nozzle as set forth in claim 17, including a third shoulder on said insert that is cooperable with a fourth shoulder on said threaded conduit.

21. A gas nozzle as set forth in claim 17, including two opposed wings on said separate insert.

22. A gas nozzle as set forth in claim 21, including two opposed recesses in said threaded conduit to receive said two opposed wings.

23. A gas nozzle as set forth in claim 22, wherein the thickness of said opposed wings is slightly greater than the depth of said opposed recesses so as to be slightly crushed into the material of said threaded conduit upon the tightening of said body onto said threaded conduit without damaging said first or second cone.

* * * * *